US006499142B1

(12) United States Patent
Lee

(10) Patent No.: US 6,499,142 B1
(45) Date of Patent: Dec. 31, 2002

(54) WOMEN'S ELASTIC FREE SIZE WINTER SHIRTS

(76) Inventor: Jong Chul Lee, Dongdaemun-Gu, Junnong 2-Dong, 127-379, Baekju Building 3rd Floor, Seoul (KR)

( * ) Notice: Subject to any disclaimer, the term of this patent is extended or adjusted under 35 U.S.C. 154(b) by 0 days.

(21) Appl. No.: 09/945,174

(22) Filed: Sep. 4, 2001

(51) Int. Cl.[7] ..... A41D 1/18
(52) U.S. Cl. ..... 2/106; 2/115; 442/306
(58) Field of Search ..... 2/69, 77, 106, 2/113, 268, 114, 125, 115, 90, 171, 59, 913, 105, 272, 120, 227, 108, 102, 456; 482/74, 121, 124, 131; 428/85, 359, 113, 114; 442/400, 409, 181, 182, 306; 450/65, 66; 66/169 R, 170, 171, 172 E; 602/60–65, 75

(56) References Cited

U.S. PATENT DOCUMENTS 4,937,883 A * 7/1990 Shirai ..... 2/113
5,659,895 A * 8/1997 Ford, Jr. ..... 2/2.11
6,047,406 A * 4/2000 Dicker et al. ..... 2/115
6,248,418 B1 * 6/2001 Taguchi et al. ..... 2/171

* cited by examiner

*Primary Examiner*—John J. Calvert
*Assistant Examiner*—Tejash Patel

(57) ABSTRACT

A woman's shirts having an omasum-inner-wall like textile structure, defined as a bulbous unit above a planar base, to render desired elasticity to a shirt. The shirt of this invention is excellent in resilient elasticity, original shape retainability and shape stability. The shirts of this invention is free size, one size fitting all. The shirt is much lighter than average women's winter shirts. Thermal insulation is adequate. Packing size is much smaller than comparable women's winter wear. The material for these shirts is composed of wool and polyester which are treated with hand followed by heat treatment with heat and moisture to make the omasum-like structure. The shirts of this invention emphasize the bodyline of women's breast and decorates the line with embossing to render a more sensual appreance.

5 Claims, 2 Drawing Sheets

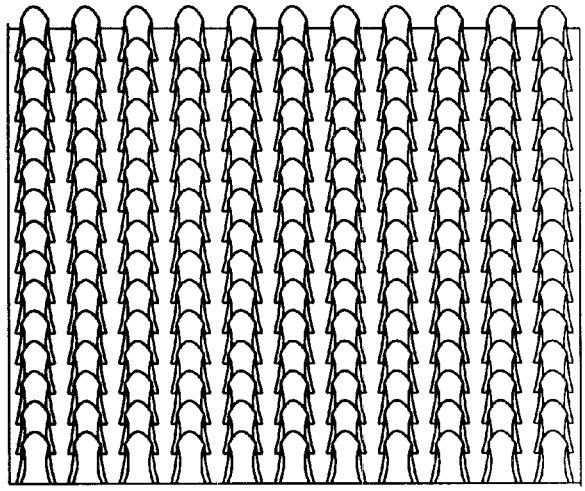
FIG. 3
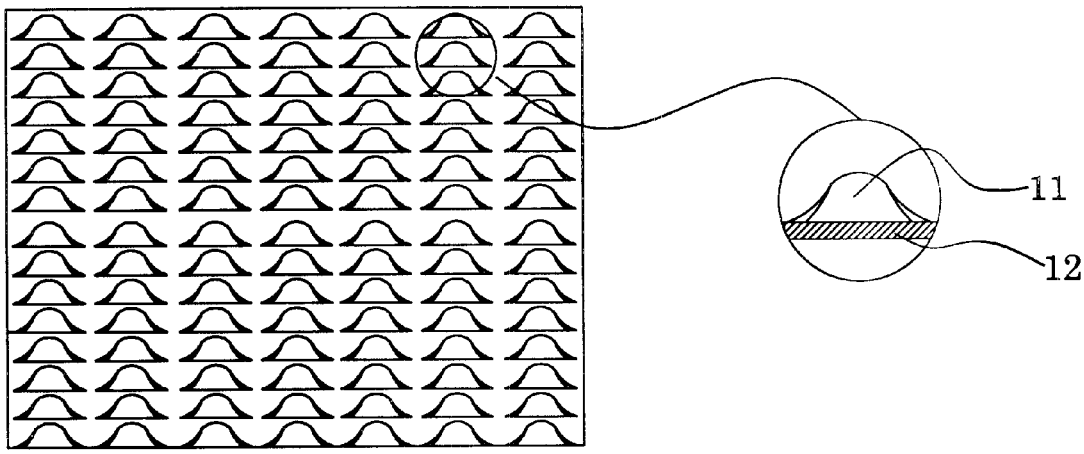
FIG. 4
FIG. 5

WOMEN'S ELASTIC FREE SIZE WINTER SHIRTS

The present invention relates to a women's elastic winter shirts having excellent resilient elasticity, original shape retainability and shape stability for the omasum inner wall-like textile structure, defined as a bulbous unit above a planar base.

BACKGROUND OF THE INVENTION

1. Field of Invention

The present invention relates to a lighter, smaller and more sensual elastic women's shirts. The omasum-like structure, defined as a bulbous unit above a planar base made by the procedure of this invention renders excellent resilient elasticity, original shape retainability and shape stability to the textile and enables to produce women's shirts which have intended characteristics.

2. Description of the Prior Art

Since they have high performance, synthetic fibers such as nylon and polyester fibers have been widely used for clothing and in industrial areas. Fibrous sheets composed of nylons and polyesters are frequently used as three-dimensional products such as interlining cloths for clothes, brassieres, and pads for breasts and shoulders. Recently, they have been applied to a shape stabilizer of the shirts made of blended yams containing polyester and cotton.

Conventional polyester fiber itself is poor in resiliency. To enhance reinsiliency, the fiber should be conjugated with highly resilient animal hair such as horse hair or even human hair for an application to interlining cloths. Sophisticated sewing technique is required to make clothing from the conjugated fibers.

U.S. Pat. No. 6,248,418 to Taguchi, et al. teaches the methods to manufacture materials having good resiliency, dimensional stability and three dimensional shape retainability from polyester itself by high speed molten polymer taking-up method followed by heat treatments. Taguchi, et al. teach to add materials such as wool to the polyester fiber by variant processing methods.

Taguchi, et al. teach to make shirts by weaving or knitting yams made by spinning only staple fiber or yarns made by mix-spinning of the staple fiber and other fibers, sewing it to form a shirt, and heat treating it at a temperature not lower than 120° C. Taguchi, et al. teach an example that a shirt made by the procedure has three dimensional shape retainability and suited to the shape of the body. None is suggested or illustrated about flexible shirts of free size, retaining the omasum-like structure, defined as a bulbous unit above a planar base.

SUMMARY OF THE INVENTION

It is the object of this invention to provide a new women's shirts, which have an omasum inner wall-like structure, defined as a bulbous unit above a planar base, to render resilient elasticity and oroginal shape retainability to the shirts.

The shirts of this invention are excellent in resilient elasticity, original shape retainability and shape stability. The shirts of this invention are free size, one size fitting all. They are much lighter than average women's winter shirts. Thermal insulation is adequate. Packing size is much smaller than a comparable women's winter wear.

The materials for these shirts are composed of wool and polyester, which are fabricated by hand followed by heat and moisture treatments to render the omasum-like structure.

The shirts of this invention emphasize the line of women's breast and decorate the body line with embossing, which is possible due to the excellent resilient elasticity and original shape retainability rendered to the material by fabricating the material to have the omasum-like structure, defined as a bulbous unit above a planar base, as illustrated in FIG. 2 and FIG. 3. At the same time it is possible to make free size shirts taking advantage of excellent resilient elasticity.

The weight of the shirt of this invention is less than 200 g/shirt in dry state, which is much lighter than a typical women's knit sweater and winter shirt. They usually weigh over 250 g/shirt.

Adequate thermal insulation effect comes from the air captured in the inner void of omasum structure, defined as a bulbous unit above a planar base, as indicated 11 in FIG. 5.

The structural characteristics of the shirt of this invention made it possible to manufacture women's winter shirt of free size which is as warm as other women's winter shirts but the packing volume and weight are smaller than those of other women's winter shirts.

BRIEF DESCRTIPTION OF THE DRAWINGS

FIG. 3 is the side view of the omasum-like structure at a normal state.

FIG. 4. is the side view of the omasum-like structure at a stretched state.

FIG. 5 is the enlarged drawing of a cross sectional view of one unit consisting the omasum-like structure.

DETAILED DESCRIPTION OF THE PREFERRED EMBODIMENTS

Figure 1:
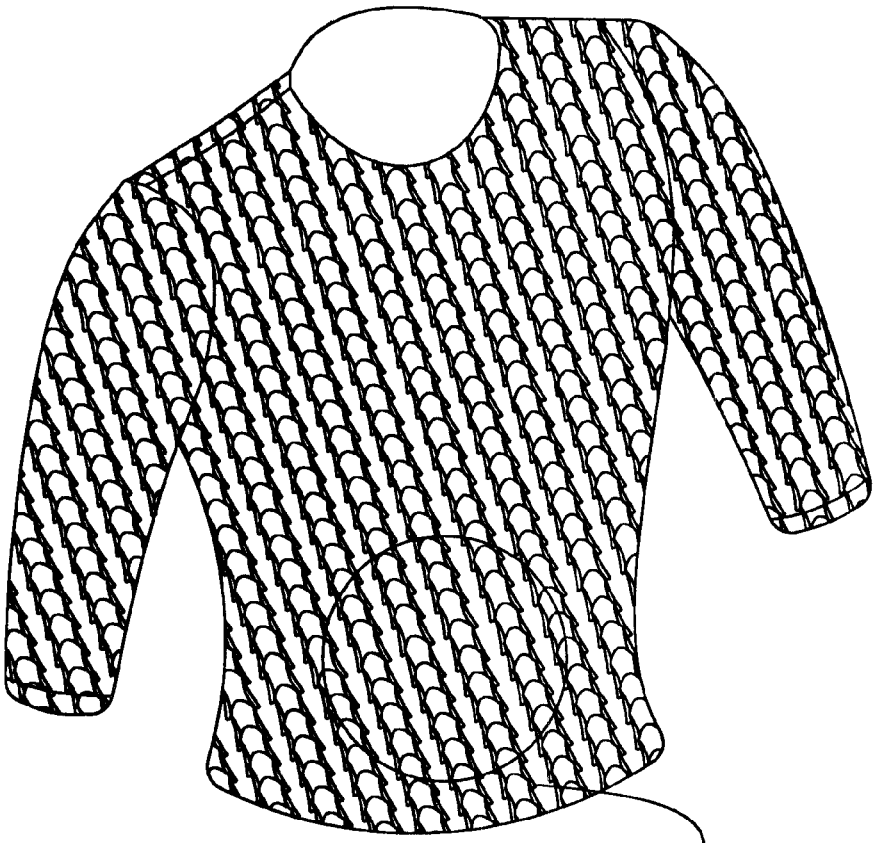
FIG. 1 is the perspective view of the shirt of this invention.

FIG. 1 is the perspective view of the shirt of this invention. As shown in FIG. 1, the shirt of this invention is made with one kind of textile which has the omasum inner wall-like structure, defined as a bulbous unit above a planar base.

Figure 2:
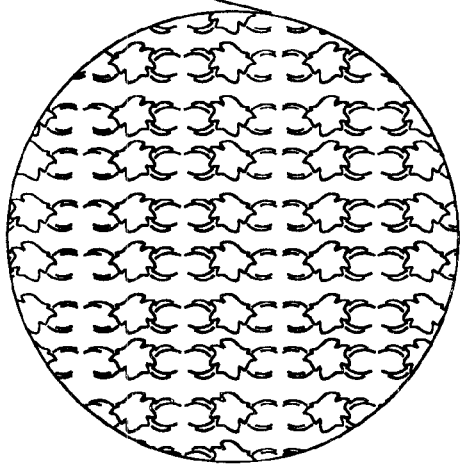
FIG. 2 is the enlarged front view of the omasum-like structure at the outer-surface of the shirt at a normal state.

FIG. 2 is the enlarged top view of the omasum-like structure, defined as a bulbous unit above a planar base, when the shirt is shrunk to a normal state. At this state the size of the shirt is almost that of baby's shirts for ages less than 3. Therefore the packing size is much smaller than conventional women's winter shirts.

FIG. 3 is the side view of the omasum-like structure of FIG. 2. Average peak density of the omasum-like structure, defined as a bulbous unit above a planar base, in FIG. 3 is 260 peaks/100 $cm^2$, horizontal 20 peaks/10 cm by vertical 13 peaks/10 cm. The peak-height of one omasum unit being 12 mm.

When a woman wears the shirt the structure changes to that shown in FIG. 4. The degree of stretching of this shirt depends on the part of women's upper body where the shirt contacts. When a woman of breast size 34 inches wears the shirt the peak density of the omasum-like structure in FIG. 3 reduces to ¼ of original density aroud the breast. Then the textile surrounding breast becomes semi-transparent while the slender waist part remains opaque. Combination of this opacity and semi-transparency along the women's bodyline renders a more sensual look.

FIG. 5 is the enlarged drawing of one unit of elements consisting the omasum-like structure, defined as a bulbous unit above a planar base. When a woman wears the shirt of this invention, the air (11) is captured in the extended unit cell surrounded by the shirt material and wearer's skin (12) and acts as insulating layer rendering adequate thermal insulation to the shirt.

What is claimed is:

1. A women's elastic winter shirts having an omasum inner-wall-like textile structure, manufactured as free size, one size fitting all, maintaining their original shape after at least 100 times wearing by a woman of normal size, becoming partly semi-transparent and partly opaque when dressed to set off the upper bodyline of the wearer, the peak density of the omasum-like structure at a normal state is 260 peaks/100 $cm^2$, horizontal 20 peaks/10 cm by vertical 13 peaks/10 cm, and the height of one omasum unit being 12 mm.

2. The weight of a shirt in claim 1 is less than 190 g/shirt in dry state.

3. The overall heat conductivity of the shirt in claim 1 is in the range of 0.01 to 500 BTU/$cm^2$.cm.sec. ° K.

4. The apprearant density of a shirt in claim 1 is in the range of from 0.3 to 1.3 g/$cm^3$ at atmosphric condition.

5. The height of one omasum-like structure's unit in claim 1 has height from 1 to 12 mm depends on the degree of extension.

* * * * *